US005859501A

United States Patent [19]

Chi

[11] Patent Number: 5,859,501

[45] Date of Patent: Jan. 12, 1999

[54] RADIO FREQUENCY GENERATING SYSTEMS AND METHODS FOR FORMING PULSE PLASMA USING GRADUALLY PULSED TIME-MODULATED RADIO FREQUENCY POWER

[75] Inventor: Kyeong-koo Chi, Kyungki-do, Rep. of Korea

[73] Assignee: Samsung Electronics Co., Ltd., Suwon, Rep. of Korea

[21] Appl. No.: 818,256

[22] Filed: Mar. 14, 1997

[30] Foreign Application Priority Data

Apr. 30, 1996 [KR] Rep. of Korea ..... 96-13913

[51] Int. Cl.[6] ..... H05H 1/46

[52] U.S. Cl. ..... 315/111.21; 313/231.31; 333/99 PL

[58] Field of Search ..... 315/111.21; 313/231.31; 118/723 R; 33/99 PL

[56] References Cited

U.S. PATENT DOCUMENTS

| | | | |
|---|---|---|---|
| 4,935,661 | 6/1990 | Heinecke et al. | 315/111.21 X |
| 5,273,609 | 12/1993 | Moslehi | 313/231.31 X |

OTHER PUBLICATIONS

Greines, J.H. and Halperin A.; "RF Sputtering Technique"; *IBM Technical Disclosure Bulletin*; vol. 17, No. 7; Dec. 1974; pp. 2172–2173.

*Primary Examiner*—Benny T. Lee

*Attorney, Agent, or Firm*—Myers Bigel Sibley & Sajovec

[57] ABSTRACT

A radio frequency (RF) generating system for forming pulse plasma utilizes a plasma reaction device comprises a function generator, an amplifier, and an input port. The function generator generates a signal of time-modulated RF power according to a modulation function having a waveform, wherein the waveform gradually ascends at a rising edge and gradually descends at a falling edge. The input port receives the signal from the function generator and transmits the signal to the amplifier. The amplifier amplifies the signal to a predetermined level and then transmits the amplified signal to the plasma reaction device. A method for forming pulse plasma comprises the steps of generating a time-modulated RF power signal according to a modulation function having a waveform, wherein the waveform is shaped to gradually ascend at a rising edge and to gradually descend at a falling edge, amplifying the time-modulated RF power signal to a predetermined level, and transmitting the amplified time-modulated RF power signal to a plasma reaction device. In an embodiment of the present invention, the waveform is a half sine waveform, though other suitable waveforms include a half cosine waveform and a Gaussian pulse signal.

14 Claims, 4 Drawing Sheets

RADIO FREQUENCY GENERATING SYSTEMS AND METHODS FOR FORMING PULSE PLASMA USING GRADUALLY PULSED TIME-MODULATED RADIO FREQUENCY POWER

FIELD OF THE INVENTION

The present invention generally relates to radio frequency (RF) generating systems and methods, more particularly, RF generating systems and methods for use in forming pulse plasma.

BACKGROUND OF THE INVENTION

In the fabrication of integrated circuits, it is highly desirable in certain circumstances to use an etching process having a specific selectivity and a high aspect ratio to enable a higher degree of device integration. To that extent, the use of pulse plasma (e.g., time-modulated plasma) is an emerging technology that is under active development. For instance, in forming a polycide layer in an integrated circuit, it has been suggested that improved results are obtainable by using an etching method that utilizes pulse plasma technology. Particularly, it has been found that the notches and profiled defects in a pattern may be removed by applying time-modulated radio frequency (RF) power having a step function to the plasma etching when forming the polycide layer. The RF power is usually modulated into a step function by a repetitive on/off operation. This repetitive on/off operation of the RF power generates the step function in discrete repeating periods. Thus, the use of pulse plasma etching is a generally simple operation that may significantly reduce the notching and side attack during the etching of polycide or polysilicon.

FIG. 1 illustrates an RF generating system as in the prior art for generating time-modulated RF power for use in generating pulse plasma. The RF generating system 10 comprises an oscillator 12 for generating the RF power, an RF power amplifier 14 for amplifying the RF power to a required level, and a mixer 16 interposed between the oscillator 12 and amplifier 14 for receiving an external modulation function, such as a step function. Therefore, when the signaling step function is high, the RF power is passed on to the amplifier 14, and when the step function is low, no RF power is passed on to the amplifier 14. Accordingly, the RF power signal is modulated into a periodic pulse prior to being supplied to a plasma reaction device 20.

FIG. 2 shows a general waveform of the time-modulated RF power signal that is produced by the RF generating system 10 and applied to the plasma reaction device 20 of FIG. 1. The time-modulated RF power has a function F(ω) that can be expressed as Equation (1) below:

$$F(\omega t)=f(\omega_0 t)\cdot g(\omega t) \tag{1}$$

where F(ωt) is the function representing the time-modulated RF power, $f(\omega_0 t)$ is the continuously generated RF power, and g(ωt) is the modulation function (i.e., the step function). The RF power generated by oscillator 12 can be expressed as Equation (2) below:

$$f(\omega_0 t)=A \sin \omega_0 t \tag{2}$$

where A represents the amplitude and $\omega_0$ represents the angular frequency of the applied RF power. An illustration of the waveform $f(\omega_0 t)$ is provided in FIG. 3A. The modulation function g(ωt) can be expressed as Equation (3) below:

$$g(\omega t)=1 \ (0<t<T_1), \text{ or}$$

$$g(\omega t)=0 \ (T_1<t<T)$$

$$g[\omega(t+T)]=g(\omega t) \tag{3}$$

where T denotes the period of the modulation function, and where $0<T_1<T$. Further, ω denotes an angular frequency of the modulation function. Accordingly, g(ωt) has the form of a step function that will turn on the RF power for a predetermined time $T_1$, and turn off the RF power for the remainder of the time period T. An illustration of the waveform g(ωt) is provided in FIG. 3B.

In order to analyze the frequency response of the function F(ωt) of the modulated RF power, the frequency response of the modulation function g(ωt) is analyzed first. Assuming that the ratio of a duty cycle of the modulated function g(ωt) is 50%, that is, $T_1=T/2$, then g(ωt) can be expressed as the Fourier series of Equation (4) below:

$$g(\omega t)=\frac{1}{2}+\frac{2}{\pi}\cdot\sum_{k=1}^{\infty}\frac{1}{2k-1}\sin(2k-1)\omega t \tag{4}$$

where k is a dummy symbol, also referred to as an index of summation. When $f(\omega_0 t)=A \sin \omega_0 t$, then the waveform of the time-modulated RF power can be expressed as function F(ωt) in Equation (5) below:

Therefore, when the RF power F(ωt) of Equation (5) is modulated with the modulation function g(ωt) of Equation (4), a series of sidebands are formed adjacent to a carrier frequency. In the present case, the frequency and amplitude of the sidebands are $\omega_0\pm(2k-1)\omega$ and $A/\pi\cdot 1/(2k-1)$, respectively. This is graphically illustrated in FIG. 4, wherein the frequency spectrum distribution of the function F(ωt) is illustrated with $$F(\omega t)=A \sin \omega_0 t\cdot g(\omega t)$$

$$\begin{aligned} F(\omega t) &= A \sin \omega_0 t\cdot g(\omega t) \\ &= \frac{A}{2}\sin \omega_0 t-\frac{A}{\pi}\cdot\sum_{k=1}^{\infty}\frac{1}{2k-1}\cos(\omega_0+(2k-1)\omega)t+ \\ &\quad \frac{A}{\pi}\cdot\sum_{k=1}^{\infty}\frac{1}{2k-1}\cos(\omega_0-(2k-1)\omega)t \end{aligned} \tag{5}$$

respect to the mode number k. As can be gleaned from FIG. 4, the sideband modes $\omega_0\pm(2k-1)\omega$ corresponding to the frequency of the modulation function g(ωt) are generated around the applied carrier frequency $\omega_0$.

When the time-modulated RF power is applied to the plasma reaction device 20, a high reflective wave is typically generated because the sideband, which has a multiplicity of frequencies, is generated over a wide bandwidth at modulation frequency intervals that are near the frequency of the RF power. The high reflective wave may be undesirable because it can damage the RF generating system 10, and thereby deteriorate the stability and reproducibility of the time-modulated RF power.

In order to reduce the effects of a high reflective wave, a matching network may be used. However, a matching network is generally tuned to a specific frequency for reducing the reflective wave at that frequency alone. Thus, a matching network may not be able to simultaneously reduce the reflective wave in a plurality of frequencies over a wide band width response, such as the one shown in FIG. 4. Therefore, the amount of RF power reflected by the pulse plasma device 20 may not be significantly reduced by a matching network because of the sideband. In severe cases, 80% or more of the applied RF power may be reflected.

SUMMARY OF THE INVENTION

It is therefore an object of the present invention to provide radio frequency (RF) generating systems for generating time-modulated RF power that can have a reduced reflected wave when forming pulse plasma.

It is another object of the present invention to provide methods for forming pulse plasma that can have a reduced reflected wave when the time-modulated RF power is applied to the pulse plasma.

It is another object of the present invention to provide systems and methods for forming pulse plasma that can enable a stable and reproducible process.

These and other objects are provided according to the present invention by forming pulse plasma utilizing RF power modulated by a waveform having a gradually ascending rising edge and a gradually descending falling edge, such as a half sine waveform. As a result, the amplitude of the sideband modes can be reduced relative to the amplitude at the carrier frequency, and thus, the reflective wave caused by the sideband can be reduced.

In accordance with the present invention, a radio frequency generating system for forming pulse plasma utilizing a plasma reaction device comprises a function generator, an amplifier, and an input port. The function generator generates a signal of time-modulated RF power according to a modulation function having a waveform, wherein the waveform gradually ascends at a rising edge and gradually descends at a falling edge. The amplifier amplifies the signal to a predetermined level and transmits the amplified signal to the plasma reaction device. The input port is interposed between the function generator and the amplifier for receiving the signal from the function generator and transmitting the signal to the amplifier.

Alternatively, the function generator may comprise an oscillator for generating an RF power signal that is sent to a mixer where it is modulated by a modulation function with a waveform that gradually ascends at a rising edge and gradually descends at a falling edge. The modulated RF power signal is then sent to the amplifier which amplifies the signal before sending it to the plasma reaction device.

The waveform of the modulation function is preferably a half sine waveform, though one of ordinary skill in the art would recognize that other waveforms such as a half cosine or a Gaussian pulse can alternatively be used. In addition, it is preferable that the pulse plasma be one selected from the group consisting of electron cyclotron resonance (ECR) plasma, inductively coupled plasma (ICP), transformer coupled plasma (TCP), helicon wave plasma (HWP), and surface wave plasma (SWP).

A method for forming pulse plasma in accordance with the present invention comprises the steps of generating a time-modulated RF power signal according to a modulation function having a waveform, wherein the waveform is shaped to gradually ascend at a rising edge and to gradually descend at a falling edge, amplifying the time-modulated RF power signal to a predetermined level, and transmitting the amplified time-modulated RF power signal to a plasma reaction device.

DETAILED DESCRIPTION OF THE PREFERRED EMBODIMENTS

Figure 1:
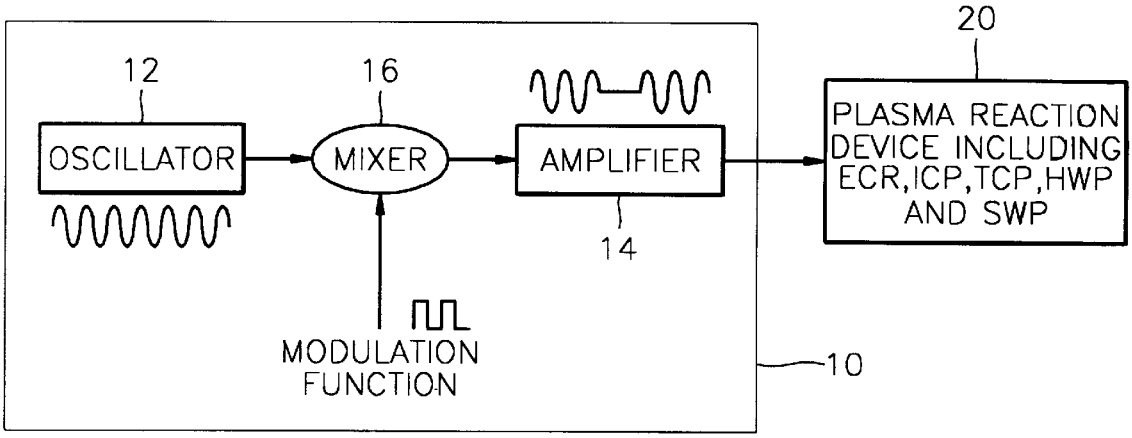
FIG. 1 (PRIOR ART)
FIG. 1 is a schematic diagram of a conventional RF generating system of the prior art used for forming pulse plasma.
Figure 2:
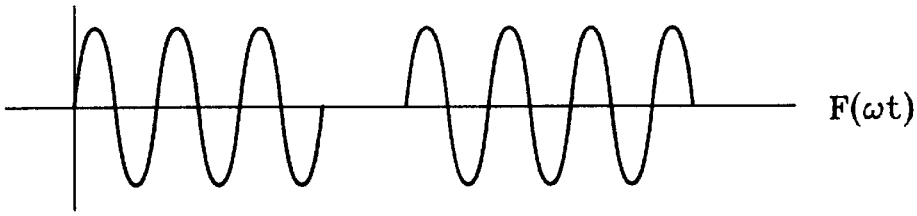
FIG. 2 (PRIOR ART)
FIG. 2 is an example of a waveform of time-modulated RF power for forming pulse plasma generated using the system of FIG. 1.
Figure 3A:
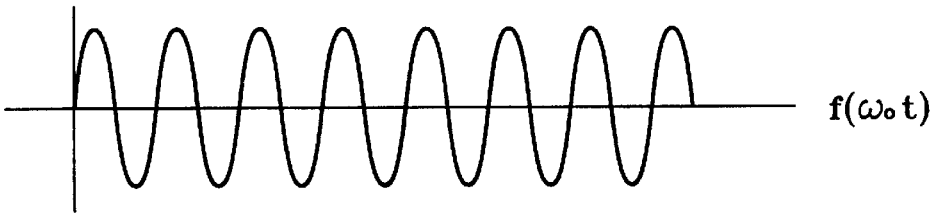
FIG. 3A (PRIOR ART)
FIGS. 3A and 3B are waveforms of functions $f(\omega_0 t)$ and $g(\omega t)$, respectively, that are combined in the system of FIG. 1 to generate the waveform function $F(\omega t)$ of FIG. 2.
Figure 3B:
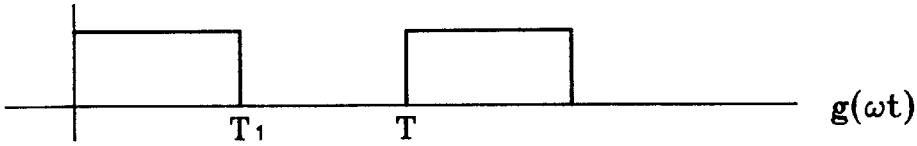
FIG. 3B (PRIOR ART)

The present invention will now be described more fully hereinafter with reference to the accompanying drawings, in which preferred embodiments of the invention are shown. This invention may, however, be embodied in many different forms and should not be construed as limiting to the embodiments set forth herein. Rather, these embodiments are provided so that the disclosure will be thorough and complete, and will fully convey the scope of the invention to those skilled in the art. In the drawings, the elements are not necessarily drawn to scale. Furthermore, like numbers refer to like elements throughout.

Figure 5:
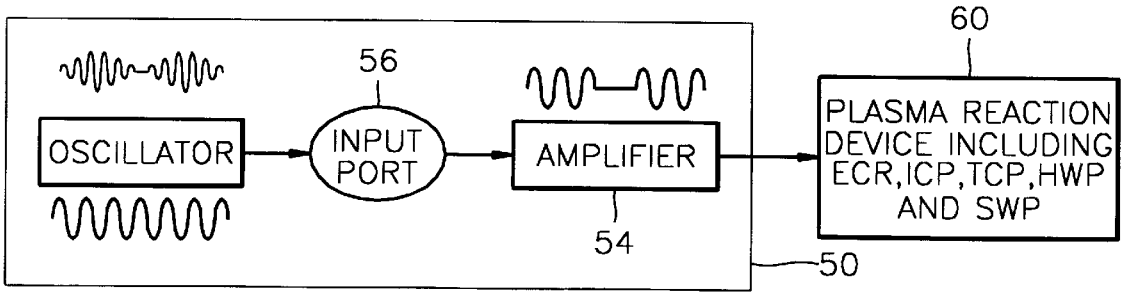
FIG. 5 is a schematic diagram of an RF generating system for forming pulse plasma in accordance with the present invention.

With reference to FIG. 5, a radio frequency (RF) generating system 50 according to the present invention includes a function generator 52, an amplifier 54, and an input port 56. The RF generating system 50 generates time-modulated RF power that can be applied to the plasma reaction device 60 for forming pulse plasma. The function generator 52 is provided for generating a pulse signal according to a function having a gradually ascending rising edge and a gradually descending falling edge waveform. The amplifier 54 is provided for amplifying the pulse signal to a predetermined level and transmitting the amplified signal to the plasma reaction device 60. It is noted that the pulse plasma of the plasma reaction device 60 is preferably in the form of a high density plasma, such as electron cyclotron resonance (ECR) plasma, inductively coupled plasma (ICP), transformer coupled plasma (TCP), helicon wave plasma (HWP), or surface wave plasma (SWP). The input port 56 is configured for receiving the pulse signal from the function generator 52 and applying the pulse signal to the amplifier 54.

In the embodiment described above with reference to FIG. 5, the function generator 52 generates a pulse signal according to the modulated function $F(\omega t)$ of the RF power. The pulse signal is then inputted to the amplifier 54 through the input port 56 and amplified to a predetermined level. The amplified RF power signal is then transmitted to the plasma reaction device 60.

Alternatively, the modulated function may be generated by an RF generating system substantially similar to the RF generating system 10 as in the prior art. However, in accordance with the present invention, the time-modulated RF power is generated by mixing the RF power from the oscillator with a modulation function having a gradually ascending rising edge and a gradually descending falling edge waveform, such as a half sine waveform, rather than with a step modulation function. The combined signal is then amplified by the amplifier and transmitted to the plasma reaction device for forming the pulse plasma.

In accordance with the present invention, a half sine function having a waveform that gradually ascends at a rising edge and descends at a falling edge can be utilized as the modulation function of the time-modulated RF power. However, other modulation functions that gradually ascend/descend at a rising edge and descend/ascend at a falling edge are equally applicable in the present invention. For example, a cosine waveform or a Gaussian pulse can be applied as a modulation function to the RF power in order to achieve a time-modulated RF power having a waveform in accordance with the present invention.

The modulation function g(ωt) is expressed as a half sine waveform in Equation (6) below:

$$g(\omega t)=\sin \omega t \ (0<t<T/2), \text{ or}$$

$$g(\omega t)=0 \ (T/2<t<T)$$

$$g[\omega(t+T)]=g(\omega t) \tag{6}$$

Figure 6:
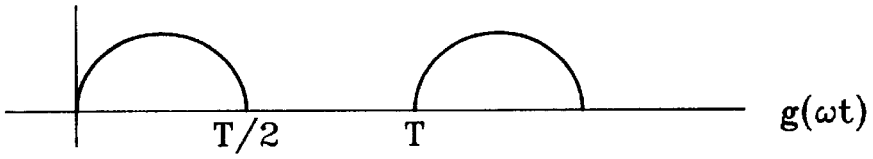
FIG. 6 is a waveform of a modulation function for modulation into a half sine waveform.

A graphical illustration of the waveform of the modulation function g(ωt) as defined by Equation (6) is provided in FIG. 6.

The modulation function g(ωt) of Equation (6) can be rewritten in the Fourier series of Equation (7) below:

$$g(\omega t)=\frac{1}{\pi}+\frac{1}{2}\sin \omega t-\frac{2}{\pi}\cdot\sum_{k=1}^{\infty}\frac{1}{(2k)^2-1}\cos 2k\,\omega t \tag{7}$$

Therefore, when $f(\omega_0 t)=A \sin \omega_0 t$, the waveform of the time-modulated RF power according to the modulation function g(ωt) can be expressed as the following modulated function F(ωt) in Equation (8) below:

$$\begin{aligned} F(\omega t) &= A \sin \omega_0 t \cdot g(\omega t) \\ &= \frac{A}{\pi}\sin \omega_0 t - \\ &\quad \frac{A}{4}[\cos(\omega_0+\omega)t-\cos(\omega_0-\omega)t]- \\ &\quad \frac{A}{\pi}\cdot\sum_{k=1}^{\infty}\frac{1}{(2k)^2-1}[\sin(\omega_0+2k\,\omega)t+\sin(\omega_0-2k\,\omega)t] \end{aligned} \tag{8}$$

Figure 7:
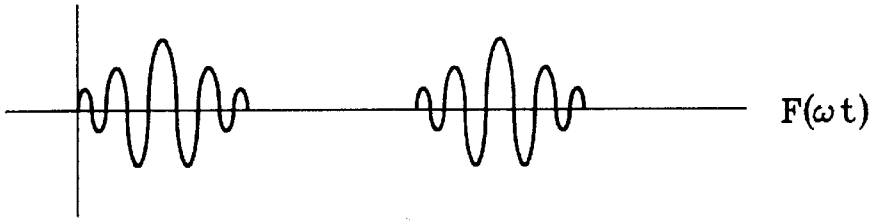
FIG. 7 is a waveform of a function modulated according to the modulation function of the half sine waveform of FIG. 6.

A graphical illustration of the waveform of the function F(ωt) modulated by the modulation function g(ωt) is provided in FIG. 7.

Figure 4:
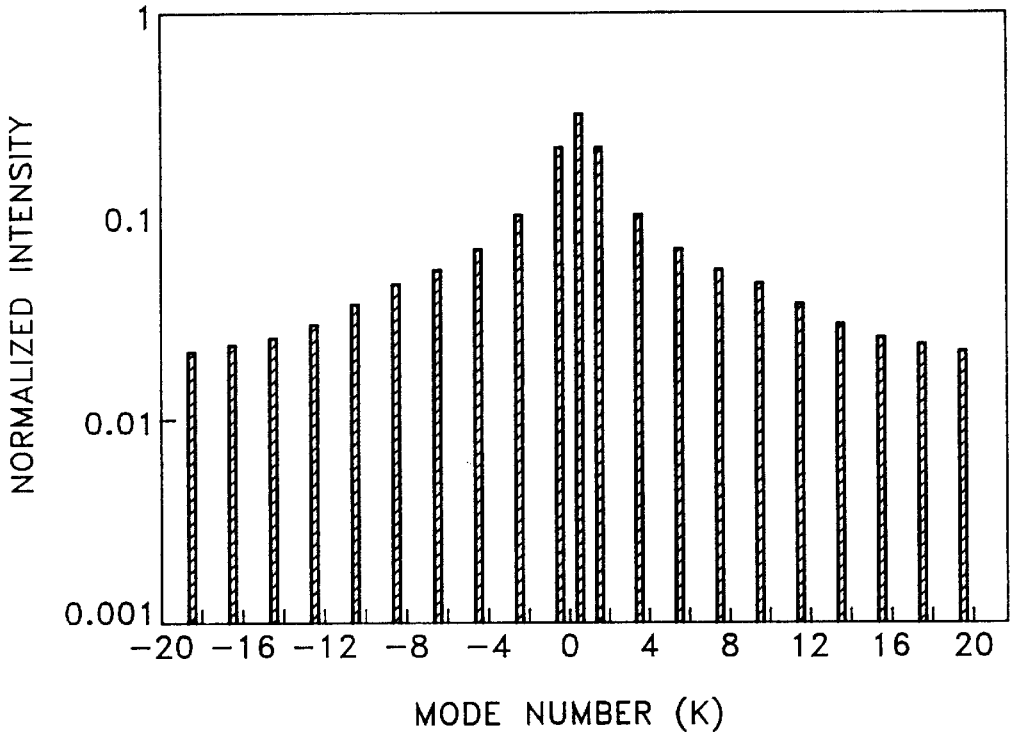
FIG. 4 (PRIOR ART)
FIG. 4 is a frequency spectrum distribution of the waveform function $F(\omega t)$ of FIG. 2 with respect to the respective mode numbers.
Figure 8:
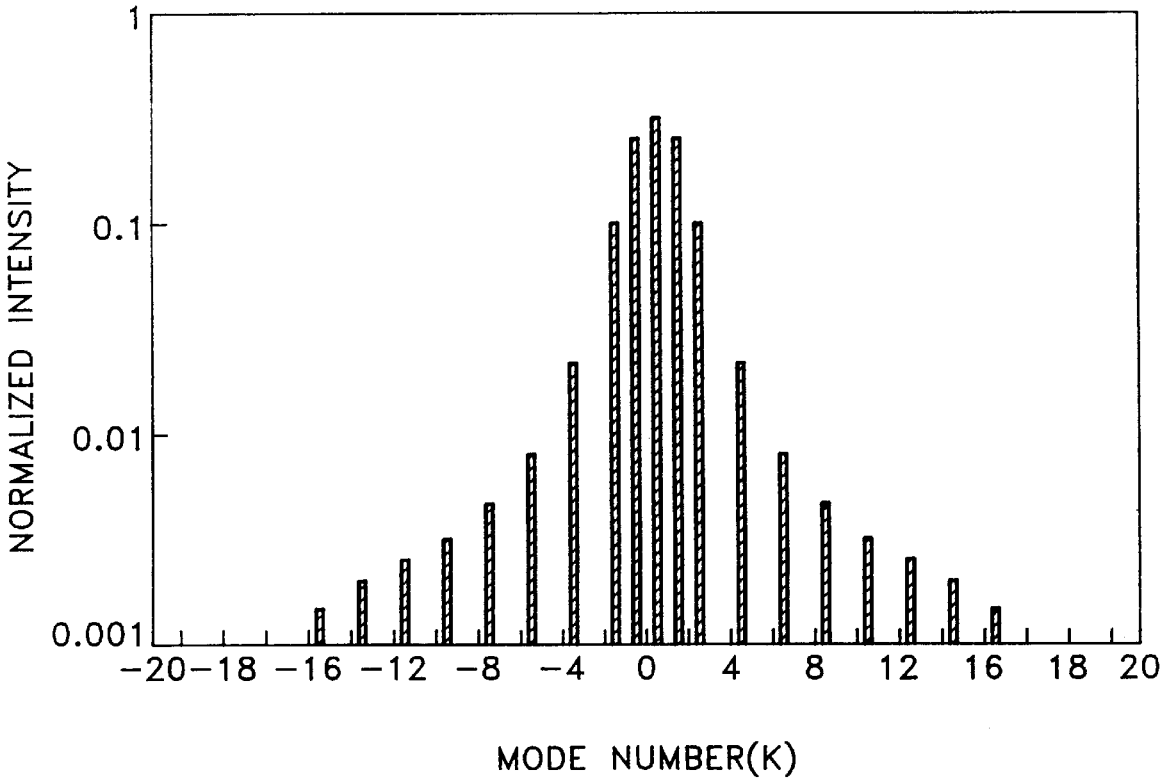
FIG. 8 is a frequency spectrum distribution of the function $F(\omega t)$ of FIG. 7 with respect to the respective mode numbers.

With reference to FIG. 8, a frequency spectrum distribution of the function F(ωt) modulated by the half sine waveform according to the modulation function g(ωt) of Equation (6) is illustrated with respect to the mode numbers k. As understood from FIG. 8, a sideband is formed near a carrier frequency $\omega_0$, i.e., a central frequency. However, the central frequency is large in comparison to the conventional case illustrated in FIG. 4, in which the modulation function is a step function. Moreover, the amplitudes of the respective modes are reduced sharply as the mode number k increases. Thus, the range of the frequency band to be matched by a matching network is narrower than that in the conventional case discussed above. Therefore, the reflected wave may be reduced more effectively using a matching network.

Figure 9A:
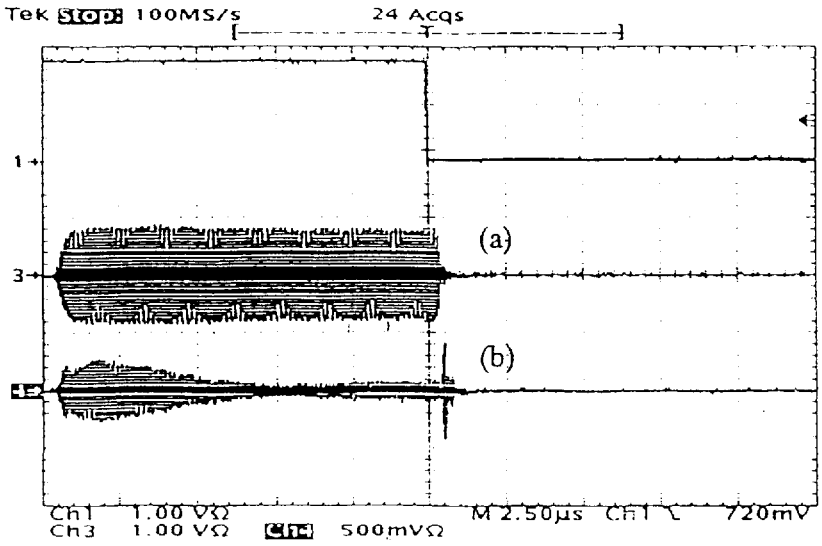
FIG. 9A (PRIOR ART)
FIGS. 9A and 9B show a digital oscilloscope's reading of the reflection waveforms obtained when RF power that is modulated according to the modulation functions of FIGS. 3B and 6, respectively, is applied to a plasma reaction device.
Figure 9B:
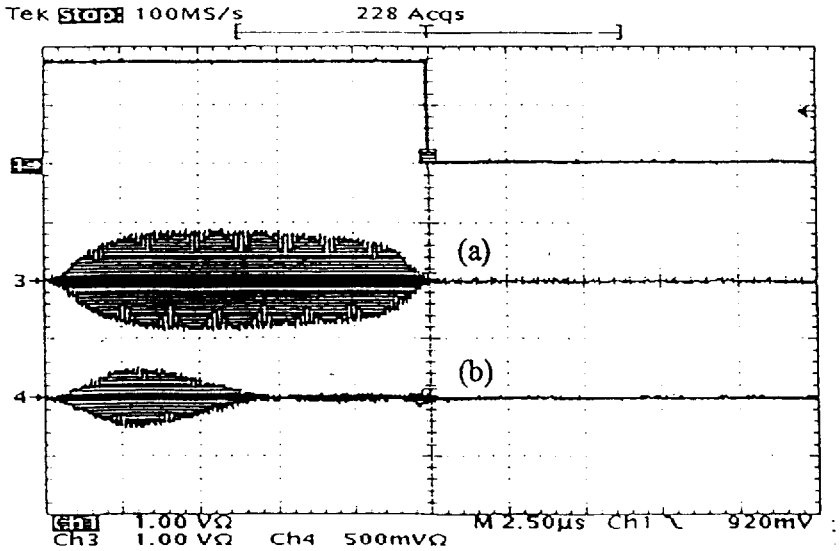

FIGS. 9A and 9B show reflection waveforms obtained by analyzing the waveforms of the RF power modulated according to the conventional modulation function (i.e., a step function) and the modulation function of the present invention (i.e., a half sine waveform for example), respectively. FIG. 9A shows an input waveform (a) and a reflection waveform (b) in the case of modulating the RF power into a step waveform, and FIG. 9B shows an input waveform (a) and a reflection waveform (b) in the case of modulating the RF power into a half sine wave form.

In the former case, as shown in FIG. 9A, when a rising time and a falling time of the input waveform are approximately 0.5 μs and 0.3 μs, respectively, the total reflected power was about 17% of the input power. Further, the waveform of the reflection power is high for the initial 5 μs of the RF pulse, and thereafter maintained a level of about 10% of the input power. At the ending portion of the reflection power, however, a sharp peak in the reflection power occurs. Therefore, most of the reflected power is generated at the beginning and ending portions of the power signal, and relatively little reflection is generated at the middle portion. Thus, it can be concluded that a large amount of the sideband signal is generated at the respective rising and falling edges of the modulated RF pulse. It can be further concluded that a small amount of the sideband signal is generated in the middle portion since the reflected power is essentially a continuous RF waveform.

In the latter case, as shown in FIG. 9B, when a rising time and a falling time of the input waveform are both approximately 2.5 μs, the reflected power is relatively low, that is, about 13% of the input power. This is a noticeable reduction in the reflected power in comparison to the reflected power of the conventional case with the step waveform modulation. In addition, there is no sharp peak at the ending portion of the reflection power.

It is concluded from the above results that most of the reflected power is generated by the peaks of the reflected power produced at the rising and falling edges of the waveform of the time-modulated RF power. Thus, the reflected power can be effectively suppressed by making the slopes of the rising and falling edges of the time-modulated RF power gradually ascending and descending shapes. Therefore, by suppressing the sideband modes using the half sine waveform as a modulation function, the reflected power may be noticeably reduced from the case where the RF power is modulated by the step waveform. As a result, the likelihood of damaging the RF generating system is reduced, and thereby improves the stability and reproducibility of the pulse plasma process. In addition, a matching network can more effectively reduce the reflective wave because of the reduced sideband.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A radio frequency (RF) pulse plasma generating system, comprising:

a function generator that generates a signal of time-modulated oscillatory RF power according to a modulation waveform including an amplitude, wherein said amplitude of said modulation waveform gradually ascends at a rising edge and gradually descends at a falling edge as compared to a step function modulation waveform; and a plasma reaction device that receives said signal and that generates said pulse plasma in response thereto.

2. The RF pulse plasma generating system of claim 1, further comprising:

an amplifier that amplifies said signal to a predetermined level and transmits the amplified signal to said plasma reaction device; and an input port that receives said signal from said function generator and transmits said signal to said amplifier.

3. The RF pulse plasma generating system of claim 1, wherein said modulation waveform is selected from a group consisting of a half sine waveform, a half cosine waveform, and a Gaussian pulse.

4. The RF pulse plasma generating system of claim 1, wherein said plasma reaction device is selected from the group consisting of electron cyclotron resonance (ECR) plasma, inductively coupled plasma (ICP), transformer coupled plasma (TCP), helicon wave plasma (HWP), and surface wave plasma (SWP) reaction devices.

5. (Amended) A radio frequency (RF) pulse plasma generating system, comprising:

function generator means for generating a signal of time-modulated oscillatory RF power according to a modulation waveform including an amplitude, wherein said amplitude of said modulation waveform gradually ascends at a rising edge and gradually descends at a falling edge as compared to a step function modulation waveform; and means for forming a plasma in response to said signal.

6. The RF pulse plasma generating system of claim 5, wherein said modulation waveform is selected from a group consisting of a half sine waveform, a half cosine waveform, and a Gaussian pulse.

7. The RF pulse plasma generating system of claim 5, wherein said means for forming a plasma is selected from the group consisting of electron cyclotron resonance (ECR) plasma, inductively coupled plasma (ICP), transformer coupled plasma (TCP), helicon wave plasma (HWP), and surface wave plasma (SWP) reaction devices.

8. (Amended) A radio frequency (RF) generating system for a plasma reaction device, comprising:

an oscillator that generates an oscillatory RF power signal;

a mixer that modulates said oscillatory RF power signal with a modulation waveform including an amplitude so as to generate a time-modulated RF power signal, wherein said amplitude of said modulation waveform gradually ascends at a rising edge and gradually descends at a falling edge as compared to a step function modulation waveform; and an amplifier that amplifies said time-modulated RF power signal to a predetermined level and transmits the amplified time-modulated RF power signal to said plasma reaction device.

9. A method for forming a radio frequency (RF) pulse plasma, comprising the steps of:

generating a time-modulated oscillatory RF power signal according to a modulation waveform including an amplitude, wherein said amplitude of said modulation waveform is shaped to gradually ascend at a rising edge and to gradually descend at a falling edge as compared to a step function modulation waveform; and applying the time-modulated RF power signal to a plasma reaction device, to thereby form the RF pulse plasma in response thereto.

10. The method of claim 9, wherein the following step is performed between said generating step and said applying step:

amplifying said time-modulated RF power signal to a predetermined level.

11. The method of claim 9, wherein said generating step comprises the step of generating a time-modulated oscillatory RF power signal according to a modulation waveform that is selected from a group consisting of a half sine waveform, a half cosine waveform, and a Gaussian pulse.

12. The method of claim 9, wherein said applying step comprises the step of applying the time-modulated RF power signal to a plasma reaction device that is selected from the group consisting of electron cyclotron resonance (ECR) plasma, inductively coupled plasma (ICP), transformer coupled plasma (TCP), helicon wave plasma (HWP), and surface wave plasma (SWP) reaction devices.

13. The method of claim 9, wherein said generating step comprises the steps of:

generating oscillatory RF power from an oscillator; and modulating said oscillatory RF power with said modulation waveform.

14. The method of claim 9, wherein said generating step comprises the step of generating said time-modulated RF power signal using a function generator.

* * * * *